US008827271B2

(12) United States Patent
Frazin

(10) Patent No.: US 8,827,271 B2
(45) Date of Patent: Sep. 9, 2014

(54) POKER TABLE ACCOMMODATING MULTIPLE DEALERS TO FACILITATE PLAY OF MULTIPLE POKER GAMES SIMULTANEOUSLY

(76) Inventor: Timothy M. Frazin, Dallas, TX (US)

( * ) Notice: Subject to any disclaimer, the term of this patent is extended or adjusted under 35 U.S.C. 154(b) by 0 days.

(21) Appl. No.: 13/416,347

(22) Filed: Mar. 9, 2012

(65) Prior Publication Data

US 2013/0234393 A1 Sep. 12, 2013

(51) Int. Cl.
*A63F 9/00* (2006.01)

(52) U.S. Cl.
USPC ..... 273/309

(58) Field of Classification Search
None
See application file for complete search history.

(56) References Cited

U.S. PATENT DOCUMENTS

| | | | | |
|---|---|---|---|---|
| 4,041,880 | A * | 8/1977 | Schankman | 108/175 |
| 5,356,140 | A * | 10/1994 | Dabrowski et al. | 463/12 |
| 5,895,047 | A | 4/1999 | Callahan | |
| 6,986,514 | B2 * | 1/2006 | Snow | 273/292 |
| 7,306,516 | B2 * | 12/2007 | Iosilevsky | 463/13 |
| 7,407,163 | B2 * | 8/2008 | Snow | 273/292 |
| 7,744,452 | B2 * | 6/2010 | Cimring et al. | 463/13 |
| 7,764,836 | B2 * | 7/2010 | Downs et al. | 382/181 |
| 7,775,887 | B2 * | 8/2010 | Kuhn et al. | 463/46 |
| 7,976,372 | B2 * | 7/2011 | Baerlocher et al. | 463/12 |
| 8,087,983 | B2 * | 1/2012 | Longway | 463/7 |
| 8,142,271 | B2 * | 3/2012 | Kuhn et al. | 463/13 |
| 8,150,157 | B2 * | 4/2012 | Downs et al. | 382/181 |
| 8,177,628 | B2 * | 5/2012 | Manning et al. | 463/21 |
| 8,251,801 | B2 * | 8/2012 | Wadds et al. | 463/25 |
| 8,262,450 | B1 * | 9/2012 | Lubin | 463/13 |
| 8,287,386 | B2 * | 10/2012 | Miller et al. | 463/43 |
| 8,342,526 | B1 * | 1/2013 | Sampson et al. | 273/149 R |
| 8,342,549 | B1 * | 1/2013 | Vey | 280/163 |
| 8,360,844 | B2 * | 1/2013 | Schwartz et al. | 463/17 |
| 2002/0017758 | A1 | 2/2002 | Buono et al. | |
| 2007/0045957 | A1 | 3/2007 | Blair | |
| 2007/0241502 | A1 | 10/2007 | Campbell et al. | |
| 2008/0194308 | A1 | 8/2008 | Falciglia | |
| 2009/0029756 | A1 | 1/2009 | Guest | |
| 2010/0001467 | A1 * | 1/2010 | Behrendsen et al. | 273/292 |
| 2011/0105224 | A1 | 5/2011 | Hartmann | |

FOREIGN PATENT DOCUMENTS

| | | |
|---|---|---|
| JP | 2008/526389 | 7/2008 |
| KR | 10/2002/043487 | 6/2002 |
| WO | WO2005/087331 | 9/2005 |

* cited by examiner

*Primary Examiner* — Kurt Fernstrom
*Assistant Examiner* — Dolores Collins
(74) *Attorney, Agent, or Firm* — Rob L. Phillips; Greenberg Traurig, LLP

(57) ABSTRACT

An elliptical, poker table incorporating two dealer stations with each dealer station including one or more of the following: automatic card shuffler, chip rack, poker cards and drop box. In one configuration, the two dealer stations are positioned oppositely on long sides of the poker table and may be offset from one another. The poker table layout may include two chip areas at each player station to accommodate different sets of chips—one for each poker game being played simultaneously. The poker table layout may depict two distinguishable common card areas.

21 Claims, 2 Drawing Sheets

POKER TABLE ACCOMMODATING MULTIPLE DEALERS TO FACILITATE PLAY OF MULTIPLE POKER GAMES SIMULTANEOUSLY

FIELD OF THE INVENTION

The embodiments of the present invention relate to a poker table configured to accommodate two or more dealers for conducting two or more poker games simultaneously.

BACKGROUND

Conventional casino style poker tables are elliptical in shape and accommodate ten or eleven players and a dealer. The poker table includes a table cut-out at the dealer station allowing the dealer to sit comfortably close to the table so that the dealer is able to deal cards and pass chips to players and also reach chips and cards passed in the direction of the dealer by the players.

Applicant has invented a poker game concept whereby players are able to play two poker games simultaneously. Thus, it would be advantageous to develop a new poker table configured to accommodate two dealers for conducting the two poker games simultaneously.

SUMMARY

The embodiments of the present invention are directed to an elliptical, poker table incorporating two dealer stations with each dealer station including one or more of the following: automatic card shuffler, chip rack and chips, poker cards and drop box as described in co-pending U.S. patent application Ser. No. 13/416,250 which is incorporated herein for all purposes. In one embodiment, the two dealer stations are positioned oppositely on long sides of the poker table and may be offset from one another. The poker table layout may include two chip areas at each player station to accommodate different distinguishable sets of poker chips—one for each poker game being played simultaneously. In one embodiment, the poker table depicts two common card areas proximate each dealer station to further maintain the independence of each poker game being played simultaneously.

Other variations, embodiments and features of the present invention will become evident from the following detailed description, drawings and claims.

DETAILED DESCRIPTION

Figure 1:
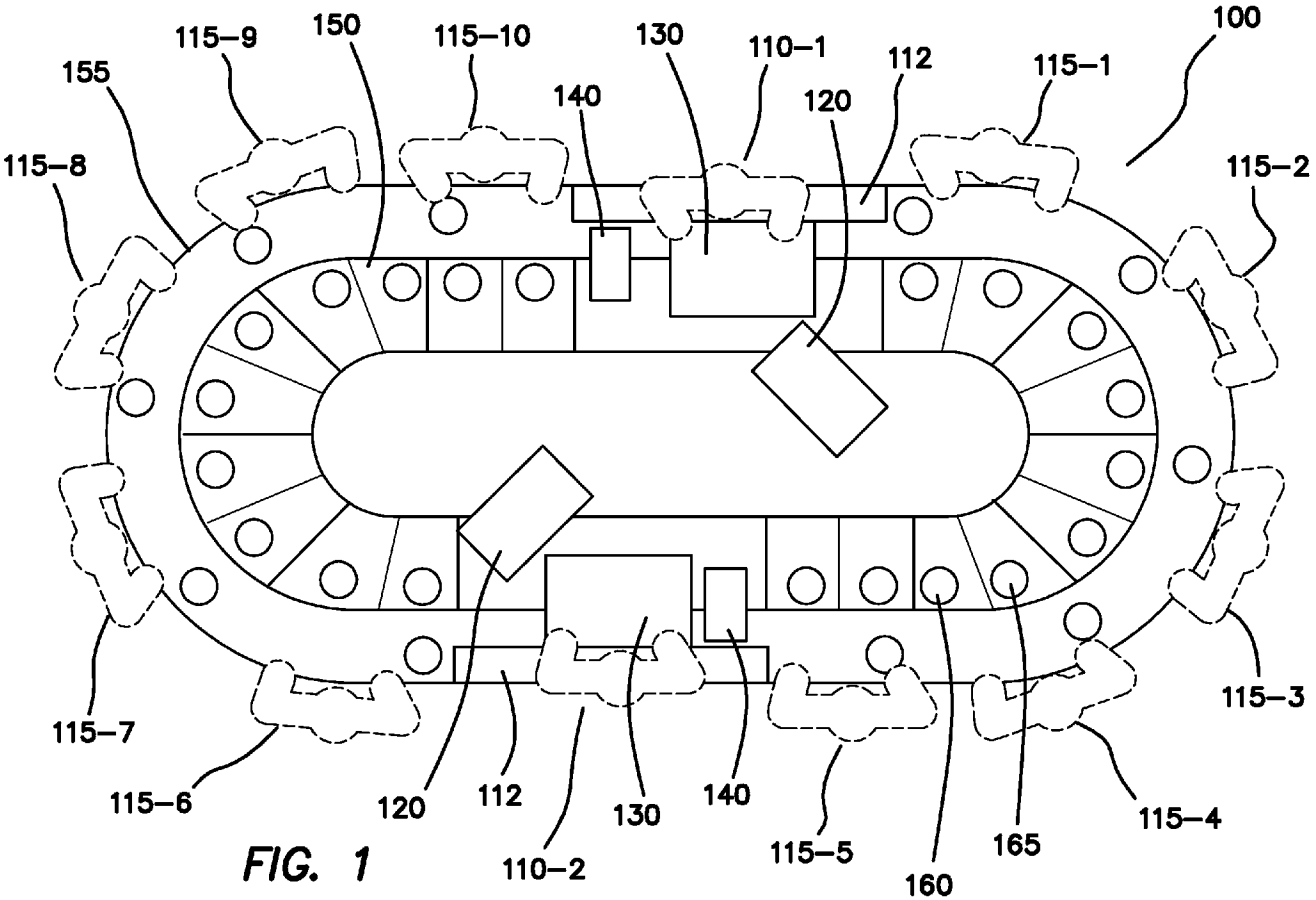
FIG. 1 illustrates an overhead view of a poker table according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

FIG. 1 shows an overhead view of a poker table 100 according to the embodiments of the present invention. As shown, the poker table 100 is elliptical in shape but those skilled in the art will recognize that other shapes are possible (e.g., circular and square). The poker table 100 incorporates a pair of dealer stations 110-1 and 110-2 and accommodates ten players at ten player stations 115-1 through 115-10. The poker table 100 may accommodate more or less than ten player stations. Depending on the embodiment, each dealer station 110-1 and 110-2 may include an automatic card shuffler 120, chip rack and chips 130 and drop box 140. In one embodiment, as shown, the dealer stations 110-1 and 110-2 are positioned oppositely on long sides of the poker table 100 in an offset relationship. Other dealer station positions are possible without departing from the scope and spirit of the embodiments of the present invention. Each dealer station 110-1 and 110-2 is defined by a cut-out area 112. Two dealer stations 110-1 and 110-2 permit two poker games to be played simultaneously on the poker table 100. While two dealer stations 110-1 and 110-2 are shown, more than two dealer stations are conceivable. A padded railing 155 circumscribes the poker table 100 in a conventional fashion.

Figure 2:
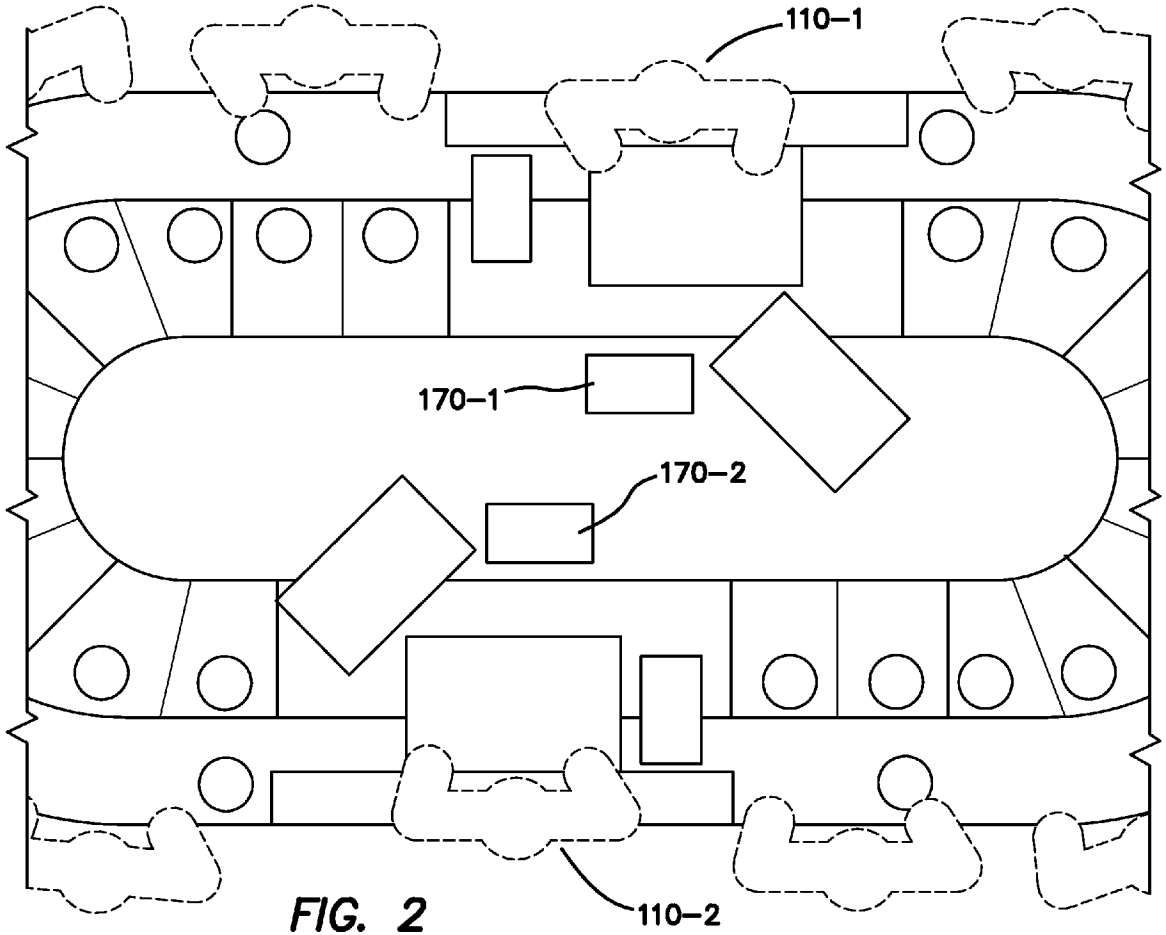
FIG. 2 illustrates an overhead view of the poker table of FIG. 1 with distinct common card areas proximate the dealer stations according to the embodiments of the present invention.

A poker table layout 150 depicts two chip areas 160, 165 at each player station 115-1 through 115-10. The two chip areas 160, 165, like the poker chips, may be colored differently or otherwise distinguished from one another to allow players to keep chips from the two poker games segregated. FIG. 2 shows the poker table 100 of FIG. 1 with distinct common card areas 170-1 and 170-2 proximate the dealer stations 110-1 and 110-2, respectively. The common card areas 170-1 and 170-2 may be defined by different colored borders or otherwise distinguished.

As detailed above, the poker table 100 facilitates the play of two poker games simultaneously. The play of two poker games simultaneously satisfies the need for "action" by poker players, especially younger players accustomed to playing multiple tables simultaneously in an online environment. In addition, the card room or poker club benefits from additional poker table revenue, which may be greater than twice normal poker table revenues, without raising overhead significantly (e.g., an additional dealer).

The poker table 100 may be suitable to conduct any number of simultaneous poker games including Texas Hold'em, Omaha and Seven Card Stud.

Although the invention has been described in detail with reference to several embodiments, additional variations and modifications exist within the scope and spirit of the invention as described and defined in the following claims.

I claim:

1. A poker table system comprising:

a layout;

two dealer stations each including the following:

(i) automatic card shuffler;

(ii) chip rack and chips, chips at a first dealer station distinguishable from chips at a second dealer station to prevent chips from being mingled during play of two separate poker games;

(iii) poker cards; and (iv) drop box; and wherein said two dealer stations facilitate the play of two poker games simultaneously whereby said chips from said first dealer station are used to form a first pot for a first poker game conducted with every player at the poker table and said chips from said second dealer station are used to form a second pot for a second poker game conducted with every player at the poker table.

2. The poker table of claim 1 wherein said layout depicts two distinguishable chip areas at each player station on said layout.

3. The poker table of claim 1 wherein said poker table is elliptical in shape.

4. The poker table of claim 3 wherein said two dealer stations are positioned oppositely along long sides of the poker table.

5. The poker table of claim 1 wherein the automatic card shufflers are integrated into the poker table.

6. The poker table of claim 1 wherein said two dealer stations are defined by cut-out areas.

7. The poker table of claim 1 wherein said layout depicts two distinguishable common card areas.

8. A poker table system comprising:

a layout;

two or more dealer stations each including the following:

(i) automatic shuffler;

(ii) chip rack and chips, chips at a first dealer station distinguishable from chips at a second dealer station to prevent chips from being mingled during play of two separate poker games;

(iii) poker cards; and (iv) drop box; and wherein said two or more dealer stations facilitate the play of two or more poker games simultaneously, said chips from said first dealer station used to form a first pot for a first poker game conducted with every player at the poker table and said chips from said second dealer station used to form a second pot for a second poker game conducted with every player at the poker table.

9. The poker table of claim 8 wherein said layout depicts two distinguishable chip areas at each player station.

10. The poker table of claim 8 wherein said poker table is elliptical in shape.

11. The poker table of claim 10 wherein said two dealer stations are positioned oppositely along long sides of the poker table.

12. The poker table of claim 8 wherein the automatic card shufflers are integrated into the poker table.

13. The poker table of claim 8 wherein said two dealer stations are defined by cut-out areas.

14. The poker table of claim 8 wherein said layout depicts two distinguishable common card areas.

15. A poker table system comprising:

a layout configured to accommodate multiple player stations and at least two dealer stations, each of said dealer stations including the following:

(i) automatic card shuffler;

(ii) chip rack and chips, chips at a first dealer station distinguishable from chips at a second dealer station to prevent chips from being mingled during play of two separate poker games;

(iii) poker cards; and (iv) drop box; and wherein said two or more dealer stations facilitate the play of two or more poker games simultaneously, said chips from said first dealer station used to form a first pot for a first poker game conducted with every player at the poker table and said chips from said second dealer station used to form a second pot for a second poker game conducted with every player at the poker table.

16. The poker table of claim 15 wherein said layout depicts two distinguishable chip areas at each player station.

17. The poker table of claim 15 wherein said poker table is elliptical in shape.

18. The poker table of claim 17 wherein said two dealer stations are positioned oppositely along long sides of the poker table.

19. The poker table of claim 15 wherein the automatic card shufflers are integrated into the poker table.

20. The poker table of claim 15 wherein said two dealer stations are defined by cut-out areas.

21. The poker table of claim 15 wherein said layout depicts two distinguishable common card areas.

* * * * *